United States Patent [19]

Colman et al.

[11] Patent Number: 4,629,555

[45] Date of Patent: Dec. 16, 1986

[54] CYCLONE SEPARATOR

[76] Inventors: Derek A. Colman, 19 Osprey Close, Lordswood, Southampton SO1 8EX; Martin T. Thew, 7 Court Close, Bitterne, Southampton SO2 5EJ, both of England

[21] Appl. No.: 694,491

[22] Filed: Jan. 24, 1985

Related U.S. Application Data

[63] Continuation of Ser. No. 434,183, Oct. 14, 1982, abandoned.

[30] Foreign Application Priority Data

Oct. 16, 1981 [GB] United Kingdom ..... 8131203

[51] Int. Cl.[4] ..... B04C 5/13; F15D 1/00

[52] U.S. Cl. ..... 209/144; 209/154; 209/211; 55/1; 55/459 R; 138/44; 138/45

[58] Field of Search ..... 209/211, 144, 154; 210/512.1, 512.2; 55/459 R, 459 A, 459 B, 459 C, 460, 1; 222/462; 439/601; 134/166, 167; 138/44, 45, 40, 41; 251/205

[56] References Cited

U.S. PATENT DOCUMENTS

| | | | |
|---|---|---|---|
| 1,065,494 | 6/1913 | Anderson | 251/205 |
| 1,393,553 | 10/1921 | Leonhardt . | |
| 1,805,106 | 5/1931 | Robinson | 251/205 |
| 1,892,260 | 12/1932 | Wick | 251/205 |
| 2,106,532 | 1/1938 | Lockett et al. | 209/211 |
| 2,321,336 | 6/1943 | Tondreau | 138/45 |
| 2,377,721 | 6/1945 | Scott | 209/211 |
| 2,648,433 | 8/1953 | Wright et al. | 209/211 |
| 2,835,387 | 5/1958 | Fontein . | |
| 3,104,965 | 9/1963 | Mast . | |
| 3,129,173 | 4/1964 | Schulze | 209/211 |
| 3,159,179 | 12/1964 | De Lain . | |
| 3,568,847 | 3/1971 | Carr | 209/211 |
| 3,734,288 | 5/1973 | Skardal | 209/211 |
| 3,988,239 | 10/1976 | Malina | 209/211 |
| 4,087,263 | 5/1978 | Schonmann, Jr. | 55/417 |
| 4,097,358 | 6/1978 | Wiseman | 55/459 R |
| 4,148,723 | 4/1979 | Mozley | 209/211 |
| 4,225,325 | 9/1980 | Diehl et al. | 210/512 R |

FOREIGN PATENT DOCUMENTS

| | | | |
|---|---|---|---|
| 980724 | 12/1975 | Canada | 209/211 |
| 540292 | 12/1931 | Fed. Rep. of Germany . | |
| 878781 | 6/1953 | Fed. Rep. of Germany . | |
| 2160747 | 6/1973 | Fed. Rep. of Germany . | |
| 7510561 | 10/1976 | Fed. Rep. of Germany . | |
| 2942099 | 4/1981 | Fed. Rep. of Germany | 209/211 |
| 2376701 | 8/1978 | France . | |
| 254791 | 1/1949 | Switzerland | 209/211 |
| 243593 | 12/1925 | United Kingdom . | |
| 865151 | 4/1961 | United Kingdom . | |
| 997712 | 7/1965 | United Kingdom . | |
| 1459693 | 12/1976 | United Kingdom . | |
| 2003758 | 3/1979 | United Kingdom . | |
| 2009632 | 6/1979 | United Kingdom . | |

OTHER PUBLICATIONS

Geer & Yancy, "Preliminary American Tests of a Cyclone Coal Washer Developed in the Netherlands", Coal Technology, Feb., 1947, p. 2.

H. B. Charmbury and D. R. Mitchell, Gravity Methods Clean Extreme Fine Sizes of Bituminous Coal, J. of Mining Engineering Feb. 1959, p. 211.

Metals and Materials, Users' Comments on an Alumina Ceramic, Journal of Eng., Aug. 3, 1962, vol. 194, p. 146.

*Primary Examiner*—S. Leon Bashore

*Assistant Examiner*—Thomas M. Lithgow

*Attorney, Agent, or Firm*—Cushman, Darby & Cushman

[57] ABSTRACT

A cyclone separator for the separation of lighter material (i.e. discontinuous or dispersed phase) can cope with fluctuating proportions of lighter material in the feed stream.

A retractable plug 15 at the place where the cyclone overflow outlet meets the cyclone body has a bore 16 forming the effective overflow outlet. The plug is retracted while the cyclone separator is in operation, in response to sensors, to offer a larger outlet 12 as the need arises.

10 Claims, 5 Drawing Figures

CYCLONE SEPARATOR

This is a continuation of application Ser. No. 434,183, filed Oct. 14, 1982, which was abandoned upon the filling hereof.

This invention is about a cyclone separator. Typical cyclone separators have a feed for material to be sorted, a body receiving the feed and in which the cyclonic separation proceeds, an overflow outlet from the body, through which outlet generally lighter material leaves the separator, and an underflow outlet from the body, through which outlet generally heavier material leaves the separator.

The invention is a cyclone separator for the separation of lighter material characterised in that its overflow outlet comprises an arrangement, operable during use of the cyclone separator, which can alter the effective cross-sectional area of the overflow outlet substantially in the plane forming the notional boundary between the overflow outlet and the body while preserving an abrupt transition from the body to the outlet. For example, reduction of the said area reduces the flow leaving via the overflow outlet. The 'lighter material' is the discontinuous or dispersed phase (which might or might not be the majority constituent on a volumetric basis).

Such a cyclone separator would simplify the task of materials sorting where the stream of material to be sorted by density into 'heavy' and 'light' fractions was subject to variations in the relative proportions of these fractions and, furthermore, where it was desirable to maximise the concentration of lighter material in the stream leaving through the overflow outlet. If the split ratio (i.e. volumetric flow rate through overflow outlet, divided by the feed flow rate) is less than the concentration of lighter material (by volume) in the feed, then some lighter material must spill into the stream leaving through the underflow outlet. This indicates that, where such spillage is undesirable, there is a minimum to the split ratio that may be used for each concentration of lighter material. On the other hand, if the split ratio is very much greater than the concentration of lighter material (by volume) in the feed, then, in the overflow, dilution of the lighter material by heavier material will be excessive. In some cases, a high split ratio will lead to a large pressure drop between the feed and the overflow.

Hitherto, the task of selecting the best arrangement for sorting of materials could be achieved by diverting the feed stream to a cyclone whose operating range of split ratio for effective separation was appropriate to the composition of the stream at the instant. This meant that cyclones with other operating ranges of split ratios would be idle. Alternatively the split ratio when operating a cyclone could for example be changed by adjustment of valves in the flows into and out of the cyclone but, in a cyclone of fixed overflow outlet size there is a minimum split ratio (which is a function of Reynolds number*) below which the flow structure becomes unfavourable for separation by the cyclone of a lighter material and so the amount by which the split ratio may be changed is limited. For example a large overflow outlet in a given cyclone may imply a minimum split ratio of 5%, say, and work well in the range 5–15% while a smaller overflow outlet in this cyclone might imply a minimum split ratio of 0.5%, say. Now, although the small outlet could be used at split ratios of 5% and above by extreme adjustment of the valves, the necessary pressure drop across the cyclone would be exorbitant and so in order to have the option of split ratios between 0.5% and 15% without having to alternate the flow between two, or more, cyclones it is desirable to have the option of a variable size overflow outlet.

*Reynolds number being base on total volumetric throughput, kinematic viscosity of continuous phase (i.e. heavy material) and a characteristic non-variable dimension of the cyclone.

The arrangement for altering the cross-sectional area of the overflow outlet (and hence automatically adjusting the split ratio) may take any of several forms. For example, an iris mechanism may be mounted at the overflow outlet. Alternatively, a plate can be mounted to slide (in a plane normal to the cyclone axis) across the overflow outlet, the plate having an edge or edges which progressively close(s) the outlet as the plate slides.

However, it is preferable for the cyclone separator internal wall in which the overflow outlet is formed to be substantially smooth, notwithstanding the presence of the arrangement in question, and therefore these iris mechanisms or plates do not give the very best performance.

The arrangement may therefore comprise a plug, which should be a sliding or close fit in the overflow outlet at least in the first position (as about to be defined), and which is movable between two positions, a first in which the end of the plug lies flush with the said internal wall and a second in which it is substantially withdrawn from the overflow outlet, the plug having a (preferably central) aperture parallel to the overflow. As will be appreciated, the aperture in the plug forms an overflow outlet of reduced cross-sectional area when the plug is in its first position. In its second position, it permits the original larger overflow outlet to have effect. Preferably the cyclone separator has a fixed spike which passes the aperture when the plug is in its second position, for clearing the aperture, which being small may become blocked.

Optionally, a nest of plugs as aforesaid may be provided to give a larger choice of overflow outlet cross-sectional areas and hence of split ratios. Thus, the minimum nest, an outer and an inner plug, will give a choice of three outlet cross-sectional areas.

The invention provides a method of classifying a stream of material according to density and/or size, the stream being subject to changes in composition, comprising passing the stream into a cyclone separator as set forth above and operating the said arrangement to alter the cross-sectional area of the overflow outlet in response to said changes. Optionally, the arrangement is operated in response to a signal from a sensor in the inlet (feed) stream 24 or one of the outlet streams, or a sensor arranged to detect blockage of the overflow outlet (especially when of reduced cross-sectional area).

The lighter material could be gas. However, when gas is present in *addition* to the lighter material being separated then it can discourage the use of a small overflow outlet in favour of a larger outlet with increased split ratio in order to maintain separation efficiency. The outlet size can be altered to suit the gas content from moment to moment.

The invention will now be described by way of example with reference to the accompanying drawings in which FIG. 1 is a cross-sectional view, looking along the axis of a cyclone, of the interior of a cyclone separator body, with part of the end removed for clarity, and showing apparatus including an arrangement in accordance with the invention, FIG. 2 is a schematic cross-section, taken on a plane including the axis, of the apparatus of FIG. 1, FIG. 3 is a cross-sectional view, taken on a plane including the axis, of a further cyclone separator according to the invention.

Figure 1:
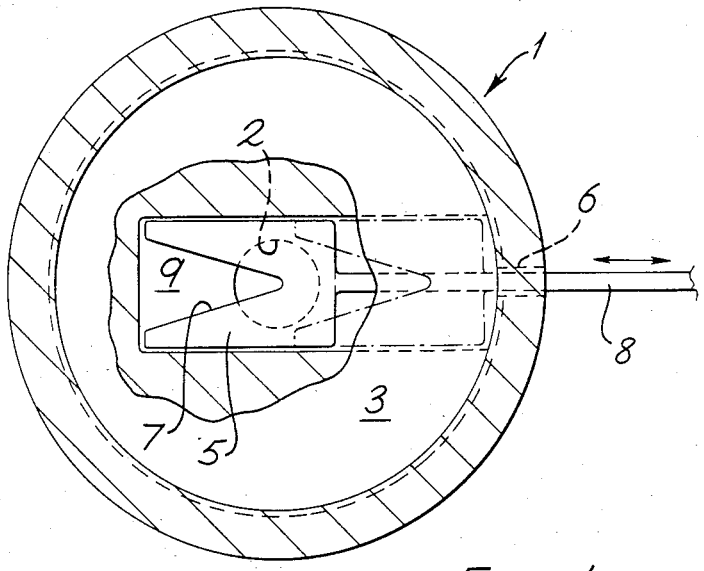
Figure 2:
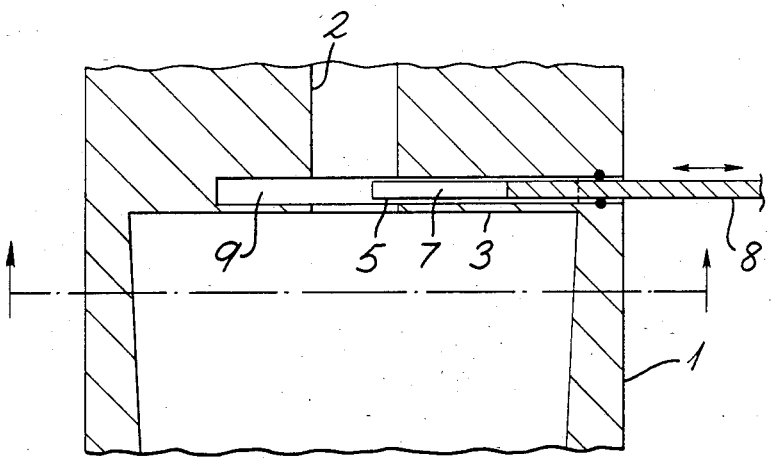

Turning to FIGS. 1 and 2, a cyclone separator body 1 has an overflow outlet 2 formed in the centre of a flat end wall 3.

A hole 6 is formed radially through the body 1 and gives into a blind flat guide slot 9 intersecting the outlet 2. The slot 9 is behind the end wall 3 but as close as practicable to it, as best seen in FIG. 2. The slot 9 accommodates a thin slider plate 5 which can slide within the slot and which is actuated by an integral tang 8 passing through the hole 6, which is fitted with an O-ring seal. The tang 8 is actuated by means not shown when, the cyclone separator being in use, a sensor in the feed 24 to the cyclone detects that a predetermined characteristic of the feed (such as its density) has gone beyond a predetermined limit.

The slider plate 5 has a deep notch 7, best seen in FIG. 1, which can partly close the overflow outlet 2, substantially in the plane of the end wall 3.

In the position of the slider plate 5 shown in full lines in FIG. 1, the notch 7 has cut the 'open' area of the outlet 2 to about one-third of the actual cross-sectional area of that outlet. To preserve some approximation to a round outlet, the base of the notch 7 is radiused, with a radius about one-third of the radius of the outlet 2.

The slider plate 5 can be moved, on 'instructions' from the sensor, to the position shown in FIG. 2, or in chain-dotted lines on FIG. 1, whereby the whole of the overflow outlet 2 becomes available for receiving a 'lighter' fraction of material being sorted by the cyclone separator. Thus, the split ratio has been increased while the cyclone was working and without interrupting the separation which it was performing. For mechanical strength, the plate 5 may have, instead of the open-ended notch 7, a crosspiece joining the distal ends of the arms defining the notch, i.e. a generally triangular hole having the same adjustable constricting effect as the notch.

A 'proportional' rather than 'on-off' sensor may be used, having the effect of moving the slider plate 5 to any intermediate position and hence adjusting the split ratio to any intermediate value. If this is not wanted, the plate 5 may, instead of a notch, have two or more round holes of different sizes, each of which can in turn overlie the outlet 2 to adjust its effective size.

Figure 3:
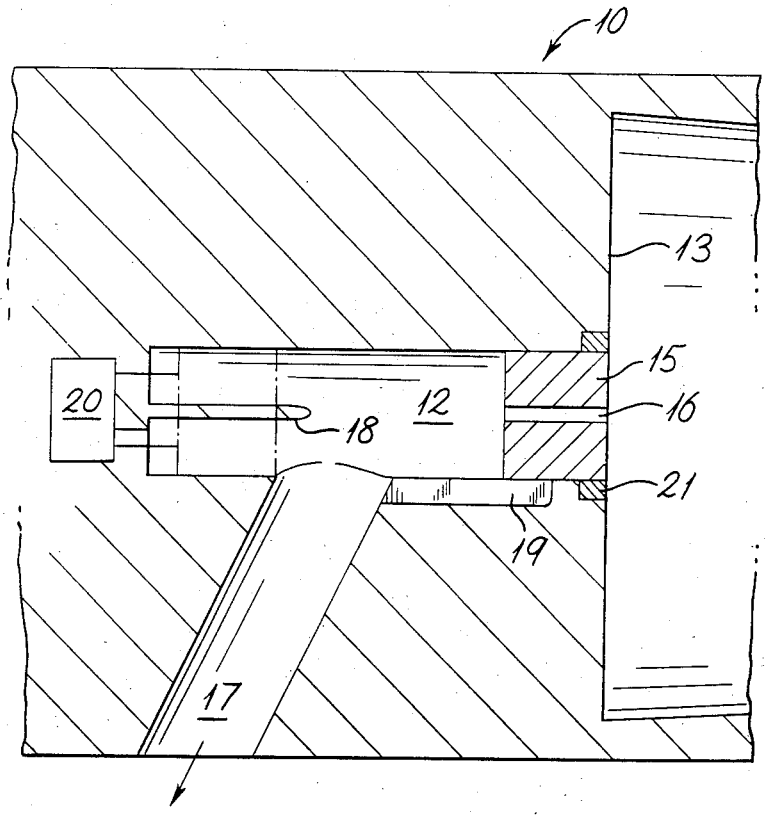

Turning now to FIG. 3, showing an alternative embodiment according to the invention, a cyclone separator body 10 has a cylindrical overflow outlet 23 opening into the centre of a flat end wall 13. An overflow outlet channel 12 with channel 17 form an overflow outlet passageway. Recess area 22, which is not part of the overflow passageway, is formed as a linear extension of channel 12 into the cyclone-body.

A cylindrical plug 15 having an axial through-bore 16 is a sliding fit in the outlet channel 12 and can move between two stations. It is shown in the drawing in a first station, lying flush with the end wall 13 and providing the cyclone separator with, effectively, an overflow outlet in the form of the bore 16. The overflow passes through the bore 16 and via the channel 17 to a collector.

A means for moving said plug shown schematically as 20, on instructions from a sensor as in the FIG. 1 embodiment, withdraws the plug 15 to its second station, shown in chain-dotted lines, just clear of the channel 17 into the recess area 22. In this way, the whole of the cross-sectional area of the outlet channel 12 is free to receive overflow; i.e. the split ratio is increased. A fixed cleaning spike 18 transfixes the plug in its second station, to clear the bore 16 of deposits or obstructions, which are flushed down the channel 17. In a tested example on an oil/water dispersion of constant input composition, a split ratio of 5% with the plug in the second position was reduced to 1% when the plug was moved to the first position, without changing the oil concentration in the underflow. For fine adjustment of the split ratio when the plug is in either position, a valve in the underflow stream could be used. A less preferable means of fine adjustment could be a valve in the overflow stream or valves in both outlet streams.

Figure 4:
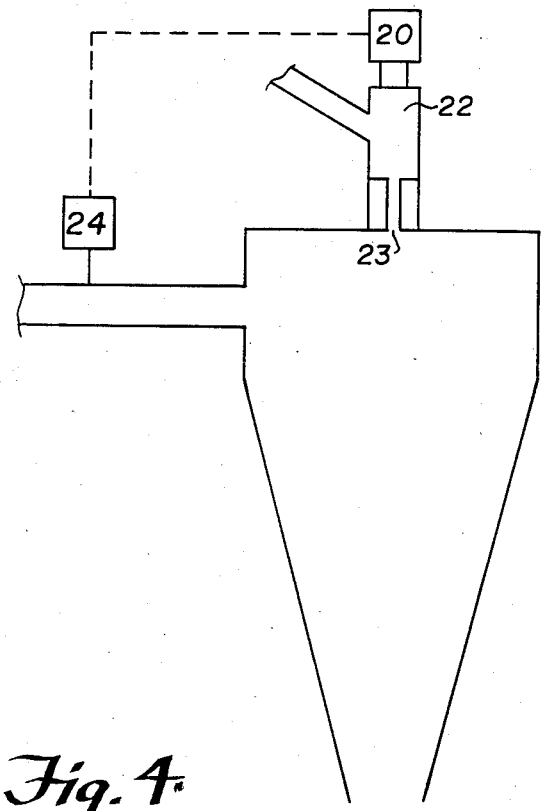
FIG. 4 is a schematic of a cyclone of FIG. 3 showing an inlet sensing feature.
Figure 5:
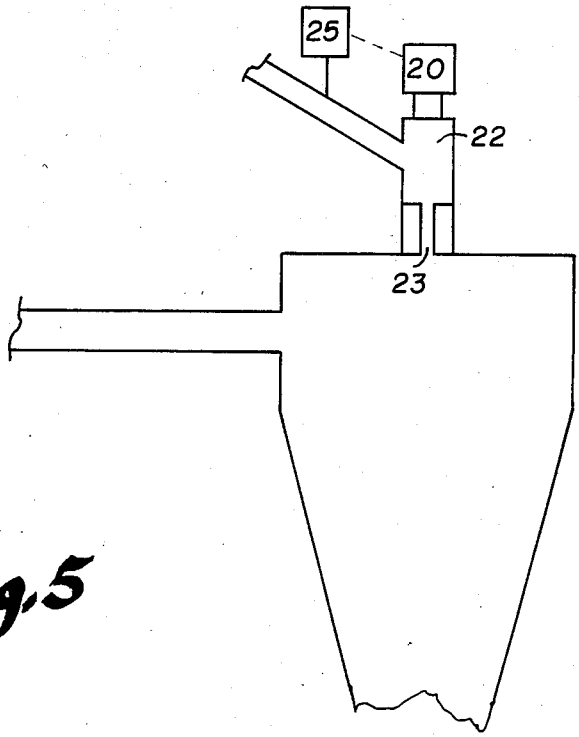
FIG. 5 is a schematic of a cyclone of FIG. 3 showing an outlet sensing feature or an outlet blockage sensor feature.

Turning to FIGS. 4 and 5, showing a schematic of the embodiment of FIG. 3, a cyclone separator is shown having inlet sensing means 24 in FIG. 4. In FIG. 5 element 25 represents either outlet sensing means or outlet blockage sensing means. Note that outlet sensing means can be located on the underflow outlet also.

To avoid the presence of a deeply stepped bore (which could upset the flow) as the plug 15 is moving to its second station, axially extending radially disposed circumferentially spaced grooves 19 (only one shown) are formed enlarging the outlet channel 12 and feeding into the channel 17. The grooves 19 stop just short of the end wall 13. When the plug 15 has been retracted a little, the overflow can start to use the grooves 19, thereby increasing the split ratio as quickly as possible.

Because of the abrasion likely where the outlet channel 12 meets the end wall 13, the 'corner' may consist of a replaceable collar insert 21 of some hard and erosion-resistant material (e.g. tungsten carbide or alumina). This will considerably reduce 'rounding' of that corner in use, thus maintaining the design geometry. The plug may be of like material.

As an alternative to the illustrated configuration of the channel 17, two channels may be formed axially spaced and radially directed of the axis of the outlet channel 12 such that in either one position of the plug 15, only one channel receives the overflow stream. Each channel can then have its own control valves and collection vessels as desired.

As an alternative to the grooves 19 and the strictly cylindrical plug 15, the plug may be frusto-conical (narrower at the end nearer the wall 13) or at least have a frusto-conical position at that end. That portion (in the first station) would seat in the outlet channel 12, which would diverge correspondingly frusto-conically from the wall 13 towards the channel 17. This avoids the engineering disadvantages of a sliding plug.

As a further alternative to the grooves 19, if the withdrawal means 20 is sufficiently fast, such as a pneumatic actuator, the plug 15 can be withdrawn or replaced so quickly that the flow structure in the cyclone is not disturbed. The grooves 19 in such a case becomes unnecessary.

The plug 15 may consist of several nested concentric collets, each retractable to the second station independently of all larger collets but only when all smaller collets have been (or are being) retracted, whereby to offer a selection, not just two, of split ratios.

In practice, an operator may wish to adjust the split ratio quickly, perhaps in response to some sudden upset in the feed composition, and all the examples shown would permit this.

We claim:

1. A cyclone separator for the separation of material according to density and/or size, having a body within which separation takes place, said body defining a feed inlet, an underflow outlet for receiving denser and/or larger material and an overflow outlet for receiving lighter and/or smaller material, said body having a smooth internal wall with said overflow outlet being formed in said smooth internal wall, there being an abrupt transition from the body to the outlet substantially in the plane of said internal wall, the body comprising overflow outlet means defining said overflow outlet, an overflow passageway, and a recessed area, said overflow passageway housing, in a first position, a movable member means for altering the cross-sectional area of the overflow outlet in the plane of said internal wall while preserving an abrupt transition from the body to the outlet, means for moving said movable member during use of the cyclone separator, said movable member comprising a plug in a first position having a sliding fit in the overflow outlet and being slideable by said means to move between a first position, in which the end of the plug lies flush with the said internal wall, and a second position in which the end of the plug is substantially withdrawn from the overflow passageway into said recessed area, the plug having an aperture the axis of which is parallel to that of the overflow outlet.

2. A cyclone separator as claimed in claim 1 wherein the the overflow passageway and the recessed area are in the form of a bore channel communicating at one end with said overflow outlet and being closed at its opposite end and a side channel intersecting said bore channel sidewardly so as to define said recessed area at said closed opposite end of said bore channel, the plug in said first position being located flush with said internal wall in said overflow passageway such that the lighter and/or smaller material exiting the separator passes through said aperture (16) in the plug and thence through said channel, the plug in said second poisiton being located in said recessed area adjacent the closed end of the bore channel such that the lighter and/or smaller material exiting the separator passes through the overflow passsageway without having to pass through said plug aperture.

3. A cyclone separator according to claim 1, wherein the aperture is central in the plug.

4. A cyclone separator according to claim 3, further comprising a fixed spike mounted to the closed end of the bore channel which passes through the plug aperture when the plug is in said second position.

5. A method of classifying a stream of material according to density and/or size, the stream being subject to changes in composition, the method comprising passing the stream into an inlet of a cyclone separator having a body within which separation takes place, an underflow outlet for receiving denser and/or larger material and an overflow outlet from the body for receiving lighter and/or smaller material, said body having a smooth internal wall with said overflow outlet being formed in said smooth internal wall, there being an abrupt transition from the body to the outlet substantially in the plane of said internal wall, an overflow outlet passageway in a first position, housing a movable member which is movable during use of the cyclone separator, and which can alter the cross-sectional area of the overflow outlet in the plane of said internal wall while preserving an abrupt transition from the body to the outlet, said movable member comprising a plug in a first position having a sliding fit in the overflow outlet and being slidable between a first position, in which the end of the plug lies flush with the said internal wall, and a second position in which the end of the plug is substantially withdrawn from the overflow outlet passageway into a recessed area, the plug having an aperture the axis of which is parallel to that of the overflow outlet, and said method further comprising sliding said apertured plug between said first and second positions to alter the cross sectional area of the overflow outlet in response to said changes of composition in said stream.

6. A method according to claim 5 wherein the apertured plug is slideably moveable between said first and second position in response to a signal from a sensor in one of the outlet streams.

7. The method according to claim 5 wherein the apertured plug is slideably moved between the first and second position in response to a signal from a sensor disposed to detect blockage of the overflow outlet.

8. The method according to claim 5 wherein the less dense material comprises from 0.5 percent to 15 percent by volume of the total.

9. A method according to claim 5, wherein the apertured plug is slideably moved between the first and second position in response to a signal from a sensor in the inlet stream.

10. A method according to claim 5, the material being classified according to density, wherein the less dense material is gas.

* * * * *